United States Patent [19]

Vasudevan

[11] 4,397,696

[45] Aug. 9, 1983

[54] METHOD FOR PRODUCING IMPROVED ALUMINUM CONDUCTOR FROM DIRECT CHILL CAST INGOT

[75] Inventor: Asuri K. Vasudevan, Pittsburgh, Pa.

[73] Assignee: Aluminum Company of America, Pittsburgh, Pa.

[21] Appl. No.: 334,654

[22] Filed: Dec. 28, 1981

[51] Int. Cl.[3] ..... C22F 1/04

[52] U.S. Cl. ..... 148/11.5 A; 148/2; 148/12.7 A

[58] Field of Search ..... 148/11.5 A, 2, 11.5 R, 148/12.7 R, 12.7 A

[56] References Cited

U.S. PATENT DOCUMENTS

| | | | |
|---|---|---|---|
| 3,512,221 | 5/1970 | Schoerner | 29/183.5 |
| 3,710,846 | 1/1973 | Properzi | 164/278 |
| 4,019,931 | 4/1977 | Setzer et al. | 148/11.5 A |
| 4,138,275 | 2/1979 | Yokota | 148/2 |
| 4,161,416 | 7/1979 | Walton | 148/12.7 |

FOREIGN PATENT DOCUMENTS

| | | | |
|---|---|---|---|
| 56-62944 | 5/1981 | Japan | 148/11.5 A |

*Primary Examiner*—L. Dewayne Rutledge
*Assistant Examiner*—Debbie Yee
*Attorney, Agent, or Firm*—Andrew Alexander

[57] ABSTRACT

Aluminum conductor is made from direct chill cast (DC) ingot with improved conductivity and creep resistance by heating an aluminum-base alloy ingot containing not more than 0.40 wt. % and preferably not more than 0.30 wt. % Fe or a mixture of Mg, Ni or Zr with Fe to a temperature of 400° to 600° C., hot rolling the ingot in this temperature range and then further hot rolling at a reduced temperature range of 175° to 325° C.

11 Claims, 2 Drawing Figures

METHOD FOR PRODUCING IMPROVED ALUMINUM CONDUCTOR FROM DIRECT CHILL CAST INGOT

BACKGROUND OF THE INVENTION

Aluminum conductor having good creep resistance properties is conventionally produced from continuous cast aluminum produced in the Properzi process, as illustrated by Properzi U.S. Pat. No. 3,710,346. A process for producing such conductor is described and claimed in U.S. Pat. No. 3,512,221 which comprises hot rolling the ingot immediately after casting to break up $FeAl_3$ particles precipitated during casting. The $FeAl_3$ particles are dispersed throughout the ingot by the hot rolling to inhibit large cell formation.

While aluminum conductor produced from Properzi-type ingot performs satisfactorily, it would be desirable to produce aluminum conductor from other processes such as the direct chill casting (DC) process due to the additional production costs involved in practicing the Properzi process. In practice, however, it has not been possible, heretofore, to produce an aluminum conductor from DC ingot having creep resistant properties comparable to aluminum conductor produced from continuous cast (Properzi) ingot.

Quite surprisingly, it has now been discovered that aluminum conductor having good creep resistance and excellent conductivity can be produced from direct chill cast (DC) ingot by careful control of the iron content and temperature conditions during working.

SUMMARY OF THE INVENTION

In accordance with the invention, aluminum conductor having good creep resistance and conductivity is produced from direct chill cast aluminum base alloy ingot containing not more than 0.40 wt.% Fe and preferably not more than 0.30 wt.% Fe by first heating the ingot to a temperature of at least 400° C., then hot rolling the ingot at this temperature, and thereafter hot rolling at a temperature of not more than 325° C.

DESCRIPTION OF THE INVENTION

Figure 1:
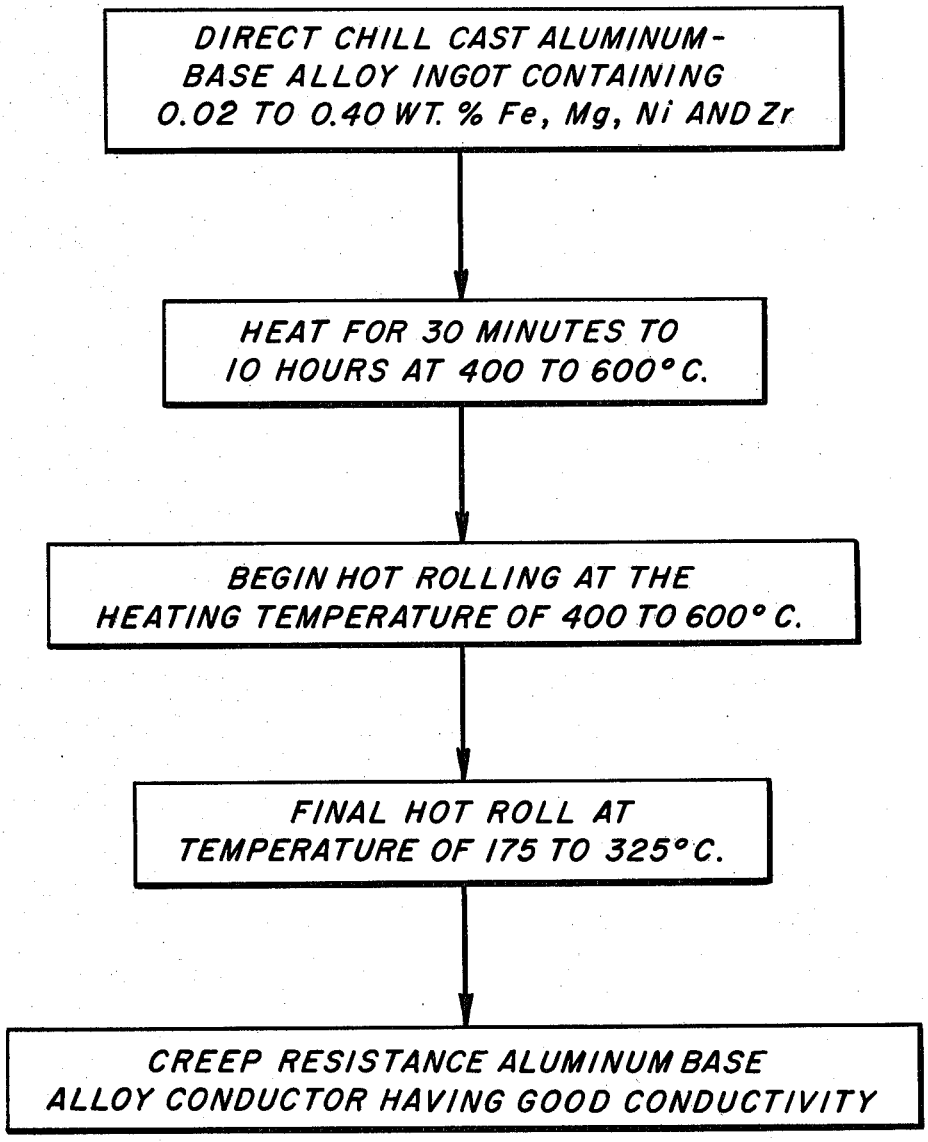
FIG. 1 is a flow sheet illustrating the process of the invention.

In the practice of the invention, an aluminum-base alloy ingot is provided. The ingot can contain 0.02 to 0.40 wt.% of Fe, Mg, Ni, Cu, Si or Zr and preferably 0.05 to 0.30 wt.%, the remainder aluminum and incidental impurities. If more than one of these elements is present, then the total amount of these elements should not exceed 0.9 wt.% with an additional 0.10 wt.% max. of other alloying elements and impurities. The preferred alloying element is iron (Fe) which may be present alone or in combination with Mg, Ni, Cu, Si or Zr, or combinations thereof, and Fe should not be present in amounts greater than 0.40 wt.%. When Mg, Ni, Cu, Si or Zr are present with the Fe, the maximum amount of any one of these elements should not be greater than 0.5 wt.%. The alloy is conveniently produced by the direct chill cast (DC) process, it being understood that ingot produced using other processes are also useful and deemed to be within the scope of the invention.

The aluminum ingot is first heated to a temperature of at least 400° C., preferably 500° to 600° C., and maintained at this temperature for a period of from about 30 minutes to 10 hours, preferably for at least 4 hours, prior to working. Longer periods of time can be utilized but are not economically feasible.

The heated ingot is then, without any substantial cooling, subjected to hot rolling starting from the same temperature where it was heated. The hot rolling is, therefore, initiated at a temperature of at least 400° C., preferably 500° to 550° C. The rolling mill comprises a conventional multistand mill having as many as 20 stands. Residence time in the mill varies with rolling speed and number of stands. Preferably, reductions in order of at least 50% or higher, e.g. 60 to 85% are desirable. These reductions can produce greater levels or amounts of subgrain, i.e. grain size less than 1 micron, and an increase in creep resistance at ambient temperature, for example.

The ingot is cooled by oil spraying or other suitable cooling means to bring the temperature during final pass down to a range of 175° to 325° C.

The following example will serve to further illustrate the process of the invention.

EXAMPLE

Aluminum-iron ingots produced by the direct chill casting (DC) process and containing 0.23 wt.% iron were heated to various temperatures for various time periods and then hot rolled at the temperatures indicated. Samples 1 through 5, listed as heated for one hour, were rolled as soon as they reached the indicated temperature, the time being indicative of the reheating time. Control A consisted of a direct cast (DC) ingot which was rolled at a temperature of 260° C. while Control B was a DC ingot rolled at a temperature of 288° C. These controls were processed conventionally, i.e. rolled as cast, without any reheating or gradual cool down during rolling. Control C represents an ingot processed in accordance with the Properzi process.

Conductivity measurements were then made on the various samples in accordance with ASTM B-398. The conductivity is given as a percentage of the International Annealed Copper Standard (IACS). Creep resistance was also determined by measuring creep strain on a 100" gage length sample. The creep strain data is presented as a 10 year predicted creep strain in microinches per inch based on the linear extrapolation from a 1000 hour creep test.

Parameter Z is calculated using the formula:

$$Z = \epsilon \exp + \frac{37300}{RT}$$

where R is the gas constant, T is the temperature and $\epsilon$ is the strain rate. The calculated strain rate on the last pass was 190.2 $sec^{-1}$. From the strain rate parameter Z, the 10 year predicted strain rate is calculated by extrapolation from 1000-hour data on creep tests using a constand load corresponding to an initial stress of 34.5 MPa.

Figure 2:
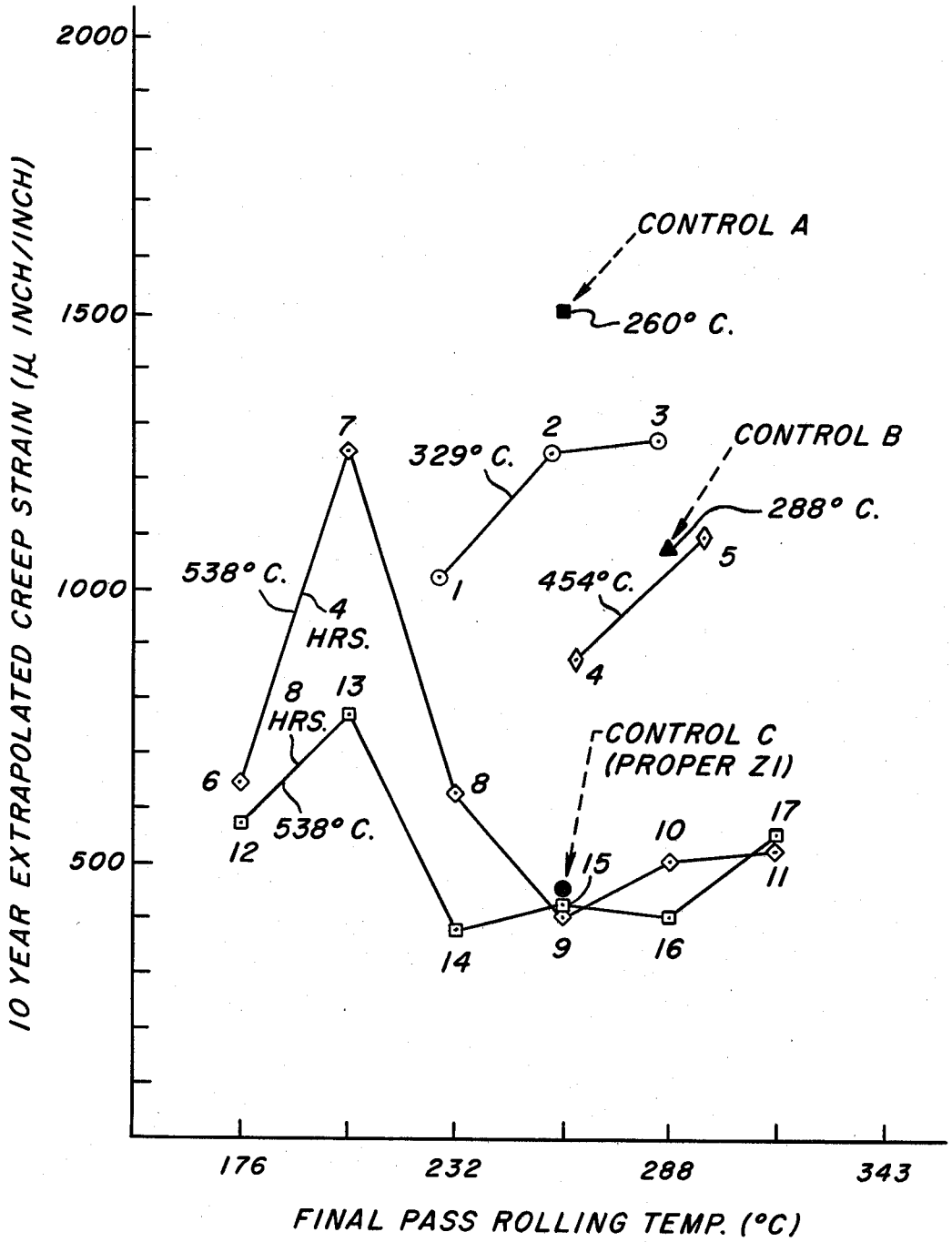
FIG. 2 is a graph plotting final rolling temperature against 10 year creep strain.

The results are shown in the table and in the graph of FIG. 2. The sample numbers are shown for each point shown on the various curves in the graph, including the three controls.

TABLE

| Sample No. | Initial Heating (°C.) | Initial Heating (hr.) | Hot Rolling (°C.) Start | Hot Rolling (°C.) Finish | Conductivity % IACS | Strain Rate Parameter Z | Strain Rate 10 Year Predicted Creep Strain microinches/inch) |
|---|---|---|---|---|---|---|---|
| Control A | 260 | — | 260 | 260 | — | — | 1525 |
| Control B | 288 | — | 288 | 288 | — | — | 1075 |
| Control C | 260 | — | 260 | 260 | — | — | 460 |
| 1 | 329 | 1 | 329 | 226 | 62.8 | 18.6 | 1030 |
| 2 | 329 | 1 | 329 | 258 | 63.1 | 17.6 | 1260 |
| 3 | 329 | 1 | 329 | 285 | 63.1 | 16.9 | 1280 |
| 4 | 454 | 1 | 454 | 263 | 63.0 | 17.5 | 880 |
| 5 | 454 | 1 | 454 | 296 | 63.0 | 16.6 | 1080 |
| 6 | 538 | 4 | 538 | 177 | 62.6 | — | 650 |
| 7 | 538 | 4 | 538 | 204 | 62.9 | — | 1260 |
| 8 | 538 | 4 | 538 | 232 | 62.8 | — | 630 |
| 9 | 538 | 4 | 538 | 260 | 62.5 | — | 420 |
| 10 | 538 | 4 | 538 | 288 | 62.5 | — | 510 |
| 11 | 538 | 4 | 538 | 316 | 62.9 | — | 520 |
| 12 | 538 | 8 | 538 | 177 | 62.6 | — | 580 |
| 13 | 538 | 8 | 538 | 204 | 62.8 | — | 770 |
| 14 | 538 | 8 | 538 | 232 | 62.3 | — | 380 |
| 15 | 538 | 8 | 538 | 260 | 62.6 | — | 440 |
| 16 | 538 | 8 | 538 | 288 | 62.6 | — | 410 |
| 17 | 538 | 8 | 538 | 316 | 62.9 | — | 560 |

In all cases, the IACS conductivity parameter was excellent. However, it will be noted that the best creep resistance figures were obtained using high temperatures for the initial rolling and lower temperatures for the final rolling. In all cases, the creep resistance showed a marked improvement over the control produced by prior art processing parameters.

While it is not intended that the invention should be limited or bound by any theory of operation, it is thought that the initial heating dissolves at least a portion of the iron content causing subsequent precipitation of $FeAl_3$, a known retardant of subgrain growth. It is believed that this precipitate, plus the specified rolling conditions, control subgrain growth in a manner advantageous to high creep resistance.

What is claimed is:

1. A method for the production of an aluminum conductor having improved creep resistance from an aluminum-base alloy ingot containing up to 0.40 wt.% of one of the group consisting of Fe, Mg, Ni, Cu, Si and Zr and not more than 0.9 wt.% when more than one of these elements are present and cast by the direct chill casting process which comprises:

(a) heating the aluminum-base alloy ingot to a temperature of from about 400° to 640° C. and maintaining the ingot at this temperature for from ½ to 10 hours;

(b) hot rolling the ingot at a first temperature of 400° to 600° C.; and (c) hot rolling the ingot at a second temperature of 175° to 325° C.

2. The method of claim 1 wherein the iron content is not more than 0.40 wt.%.

3. The method of claim 1 wherein the iron content is from 0.02 to 0.30 wt.%.

4. The method of claim 1 wherein the total Mg, Ni, Cu, Si and Zr content does not exceed 0.50 wt.%.

5. The method of claim 1 wherein the ingot is initially heated and rolled in a temperature range of 500 to 600° C.

6. A method for producing, from an aluminum-base alloy direct chill cast ingot containing not more than 0.30 wt.% iron, an aluminum conductor characterized by a conductivity of at least 62% of the International Annealed Copper Standard and a 10 year predicted creep strain of less than 1000 microinches per inch comprising:

(a) heating the ingot to a temperature of at least 400° C. to dissolve a portion of said iron;

(b) hot rolling the ingot at a temperature of at least 400° C. to precipitate at least a portion of said iron as $FeAl_3$; and (c) thereafter hot rolling the ingot at a temperature of not more than 325° C.

7. The process of claim 6 wherein the ingot is rolled as soon as it reaches the initial temperature.

8. The process of claim 6 wherein the ingot is maintained in step (a) at an initial temperature of from 400° to 600° C. for from 30 minutes to 10 hours.

9. The process of claim 8 wherein the ingot is maintained in step (a) at the initial temperature for at least four hours.

10. The process of claim 9 wherein the hot rolling commences at the same initial temperature as in step (a).

11. The process of claim 10 wherein the final temperature in step (c) is from 175° to 325° C.

* * * * *